US010365072B1

(12) United States Patent
Liu

(10) Patent No.: US 10,365,072 B1
(45) Date of Patent: Jul. 30, 2019

(54) TRAP WOBBLER

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 16/180,101

(22) Filed: Nov. 5, 2018

(51) Int. Cl.
*F41J 9/18* (2006.01)
*F41J 9/20* (2006.01)
*F41J 9/32* (2006.01)

(52) U.S. Cl.
CPC .. *F41J 9/20* (2013.01); *F41J 9/32* (2013.01)

(58) Field of Classification Search
CPC ..... F41J 9/18; F41J 9/20; F41J 9/32
See application file for complete search history.

(56) References Cited

U.S. PATENT DOCUMENTS 852,910 A * 5/1907 Sherman et al. ..... F41J 9/32 124/9
2,136,035 A * 11/1938 Altemus ..... F41J 9/20 124/8
2,668,526 A * 2/1954 Woolsey ..... F41J 9/32 124/32
4,300,520 A * 11/1981 Laporte ..... F41J 9/32 124/9
5,871,003 A * 2/1999 Laporte ..... F41J 9/18 124/8

* cited by examiner

*Primary Examiner* — John A Ricci
(74) *Attorney, Agent, or Firm* — Jackson IPG PLLC; Demian K. Jackson

(57) ABSTRACT

A trap wobbler includes a base with an inclined bearing seat and a bearing supported on the inclined bearing seat, a trap frame connector pivotally coupled to the bearing of the base for enabling the trap frame connector to be biased relative to the base, and a throwing trap fastened to the trap frame connector. When the throwing arm of the throwing trap is rotated to throw a clay, the inertia force thus generated causes the throwing trap and the trap frame connector to swing left and right. As long as the throwing arm is continuously controlled to continue throwing a clay before stopping of the swinging action of the throwing trap, the left and right swinging motions and amplitudes of the throwing trap is continuously increased.

2 Claims, 7 Drawing Sheets

TRAP WOBBLER

BACKGROUND OF THE INVENTION

1. Field of the Invention

The present invention relates to trap wobbler technology and more particularly, to such a trap wobbler, which can generate an unpredictable swing angle of the throwing trap without the need of a motor and a transmission mechanism to relatively enhance the difficulty of clay hitting.

2. Description of the Related Art

The throwing trap main body of the throwing trap is fastened with the throwing arm by means of the adapter at the power spindle of the throwing trap with the use fastening members. When the power spindle is rotated, the throwing arm is rotated to throw a clay out of the clay bearing plate by means of a centrifugal force so that the user can aim at the thrown clay to practice shooting. The related technical content mentioned above can be found in US Patent Publication No. 2017/0052003. In order to improve the difficulty of aiming, some operators will add a motor and a transmission mechanism to drive the throwing trap to swing, thereby increasing the difficulty of aiming. However, this method still has drawbacks as follows:

1. The swinging angle of the throwing trap biased by the motor and the transmission mechanism is constant. Therefore, the user can still expect the swing position, so the difficulty of lifting is limited.

2. The arrangement of the added motor and transmission mechanism not only wastes power but also increases component cost, volume and manpower and labor costs of assembly.

SUMMARY OF THE INVENTION

The present invention has been accomplished under the circumstances in view. It is therefore the main object of the present invention to provide a trap wobbler consisting of a base, a trap frame connector and a throwing trap, which is so designed that when the throwing arm of the throwing trap is rotated to throw a clay by a centrifugal force, the inertia force thus generated causes the throwing trap and the connected trap frame connector to swing left and right on the center of the inclined bearing seat of the base. As long as the throwing arm is continuously controlled to continue throwing a clay before the swinging action of the throwing trap is not yet stationary, the left and right swinging motions and amplitudes of the throwing trap can be continuously increased, thereby causing an unpredictable swing angle. Thus, the aiming hit difficulty of the clay thrown by the throwing arm of the throwing trap is relatively increased.

It is another object of the present invention to provide a trap wobbler, which does not need to separately assemble a motor and a transmission mechanism for swinging the throwing trap, which saves electricity, component cost and volume, thereby saving manpower and man-hours for assembling the aforementioned mechanism.

DETAILED DESCRIPTION OF THE INVENTION

Figure 1:
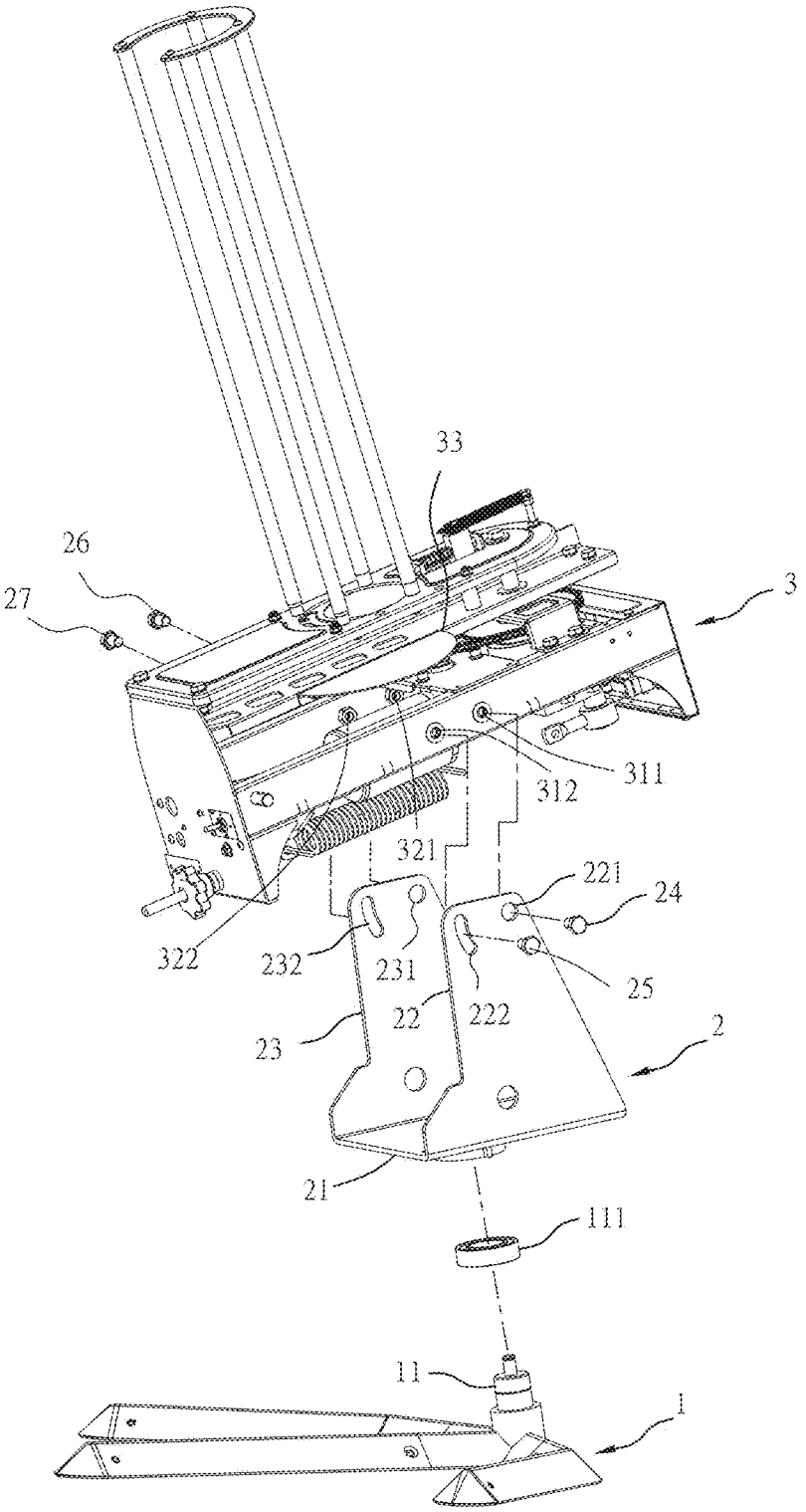
FIG. 1 is an exploded view of a trap wobbler in accordance with the present invention.
Figure 2:
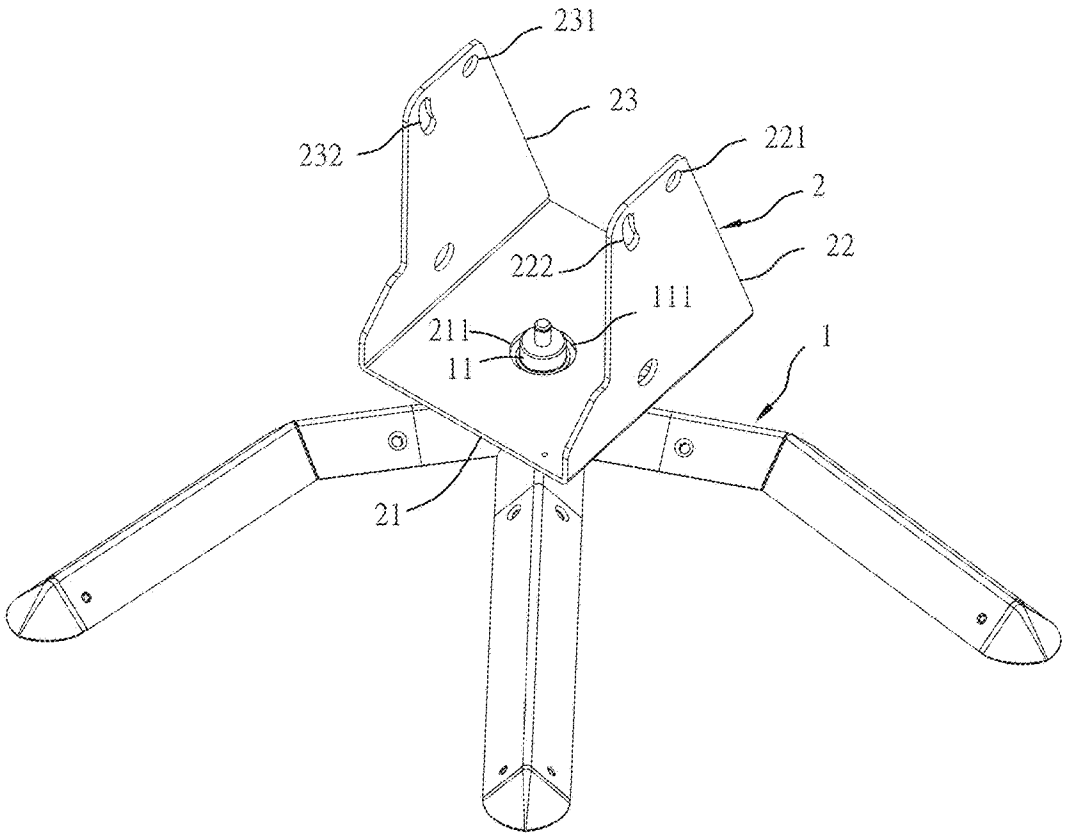
FIG. 2 is an oblique top elevation, in an enlarged scale, of the trap frame connector of the trap wobbler.

Referring to FIGS. 1-4, a trap wobbler in accordance with the present invention is shown. The trap wobbler comprises a base 1, a trap frame connector 2 and a throwing trap 3.

The base 1 comprises an inclined bearing seat 11 and at least one bearing 111 supported on the inclined bearing seat 11. The angle between the center of the inclined bearing seat 11 and the horizontal plane is 45°~85° (see FIG. 4).

The trap frame connector 2 comprises a bottom wall 21, opposing left wall 22 and right wall 23 respectively extended from opposing left and right sides of the bottom wall 21, a pivot slot 211 located on the bottom wall 21 (see FIG. 2) and pivotally coupled to the at least one bearing 111 at the inclined bearing seat 11 of the base 1 (see FIG. 2) for enabling the trap frame connector 2 to be biased relative to the base 1, and a plurality of mounting holes 221,222; 231,232 respectively and symmetrically located on the left wall 22 and the right wall 23.

The throwing trap 3 comprises a plurality of connection holes 311,312; 321,322 respectively and symmetrically located on opposing left and right side of a bottom part thereof and respectively fastened to the mounting holes 221,222; 231,232 on the left wall 22 and the right wall 23 of the trap frame connector 2 by respective fastening members 24,25; 26,27.

Figure 5:
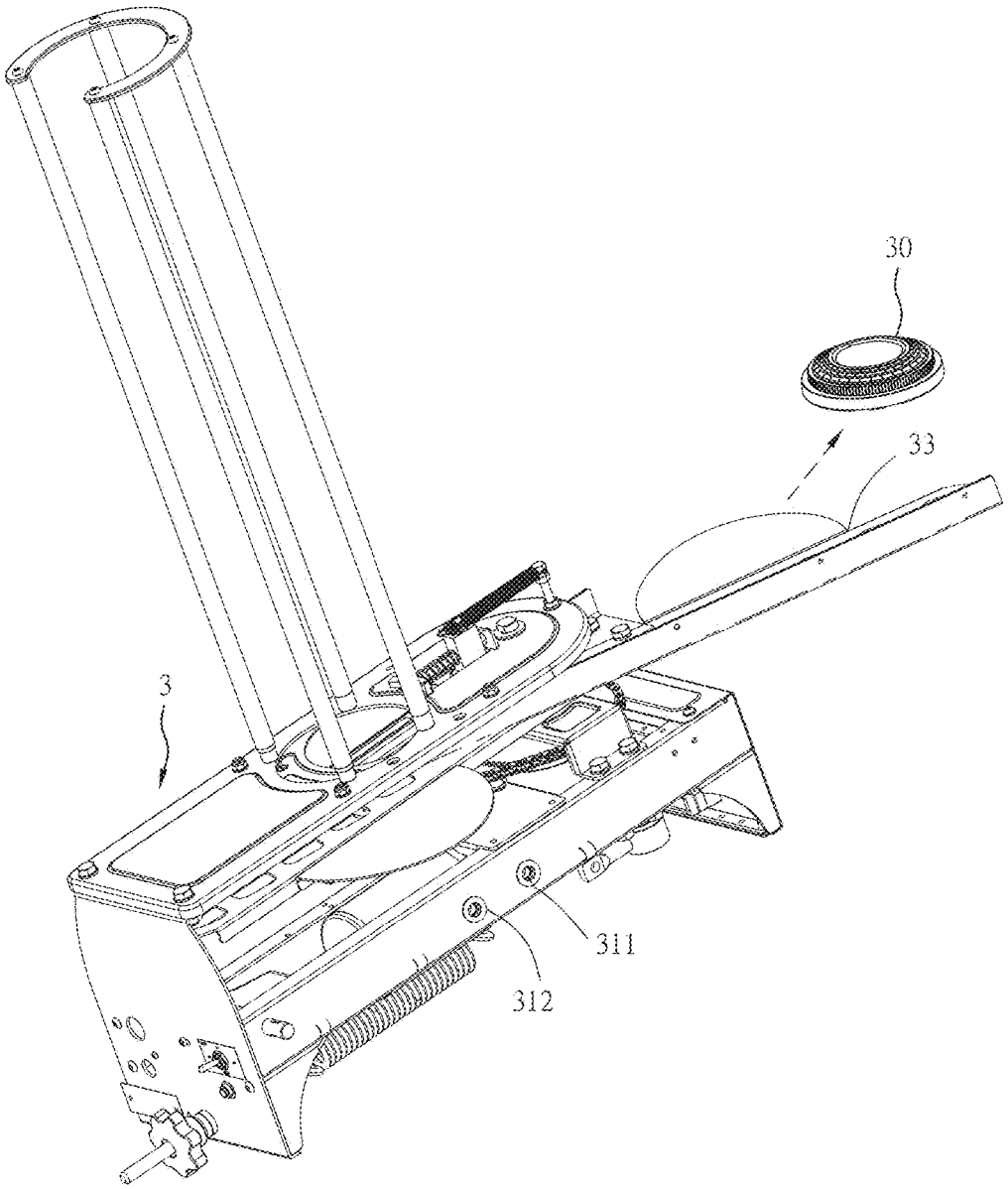
FIG. 5 is a schematic drawing illustrating the throwing arm of the throwing trap rotated and a clay thrown out of the throwing arm.
Figure 6:
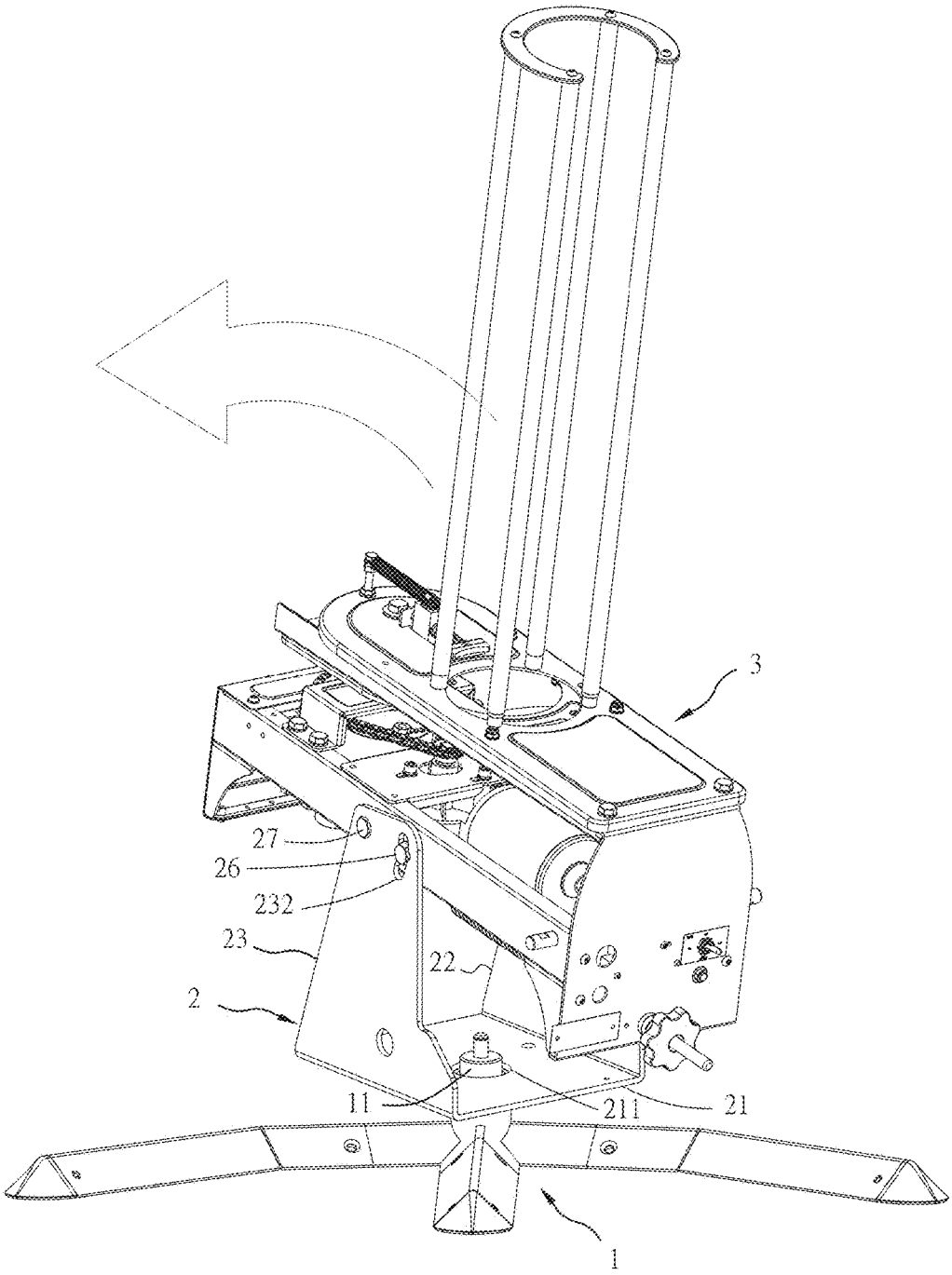
FIG. 6 is an elevational view of the present invention, showing the throwing tap biased to one side.
Figure 7:
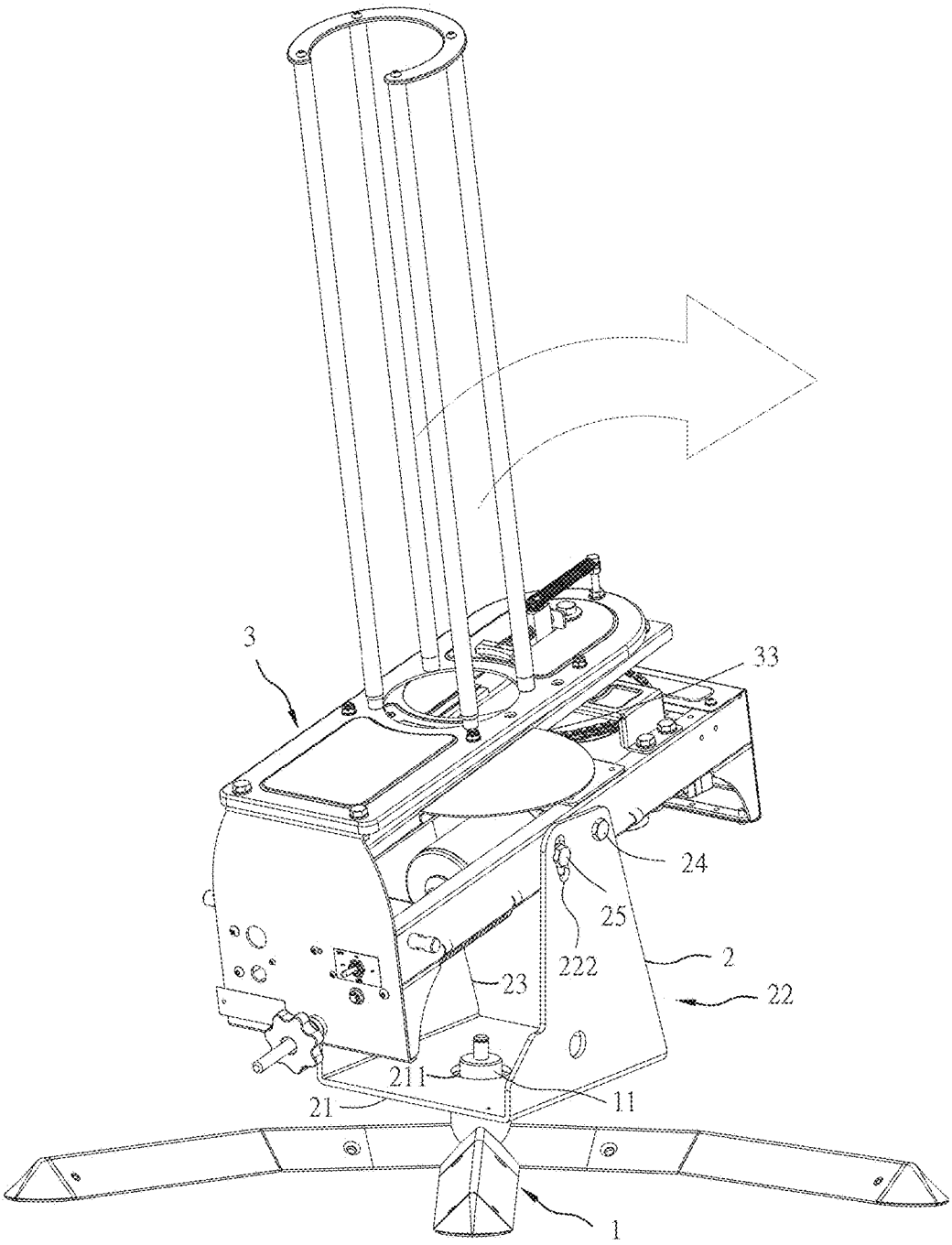
FIG. 7 corresponds to FIG. 6, showing the throwing tap biased to the other side.

Thus, when the throwing arm 33 of the throwing trap 3 is rotated to throw a clay 30 (see FIG. 5) by a centrifugal force, the inertia force thus generated causes the throwing trap 3 and the connected trap frame connector 2 to swing left and right on the center of the inclined bearing seat 11 of the base 1 (see also FIG. 6 and FIG. 7). Before the swinging action of the throwing trap 3 is not yet stationary, as long as the throwing arm 33 is continuously controlled to continue throwing a clay 30, the left and right swinging motions and amplitudes of the throwing trap 3 can be continuously increased, thereby causing an unpredictable swing angle. Thus, the aiming hit difficulty of the clay 30 thrown by the throwing arm 33 of the throwing trap 3 is relatively increased, thereby further enhancing the effect of the aiming practice of the throwing trap 3.

Figure 3:
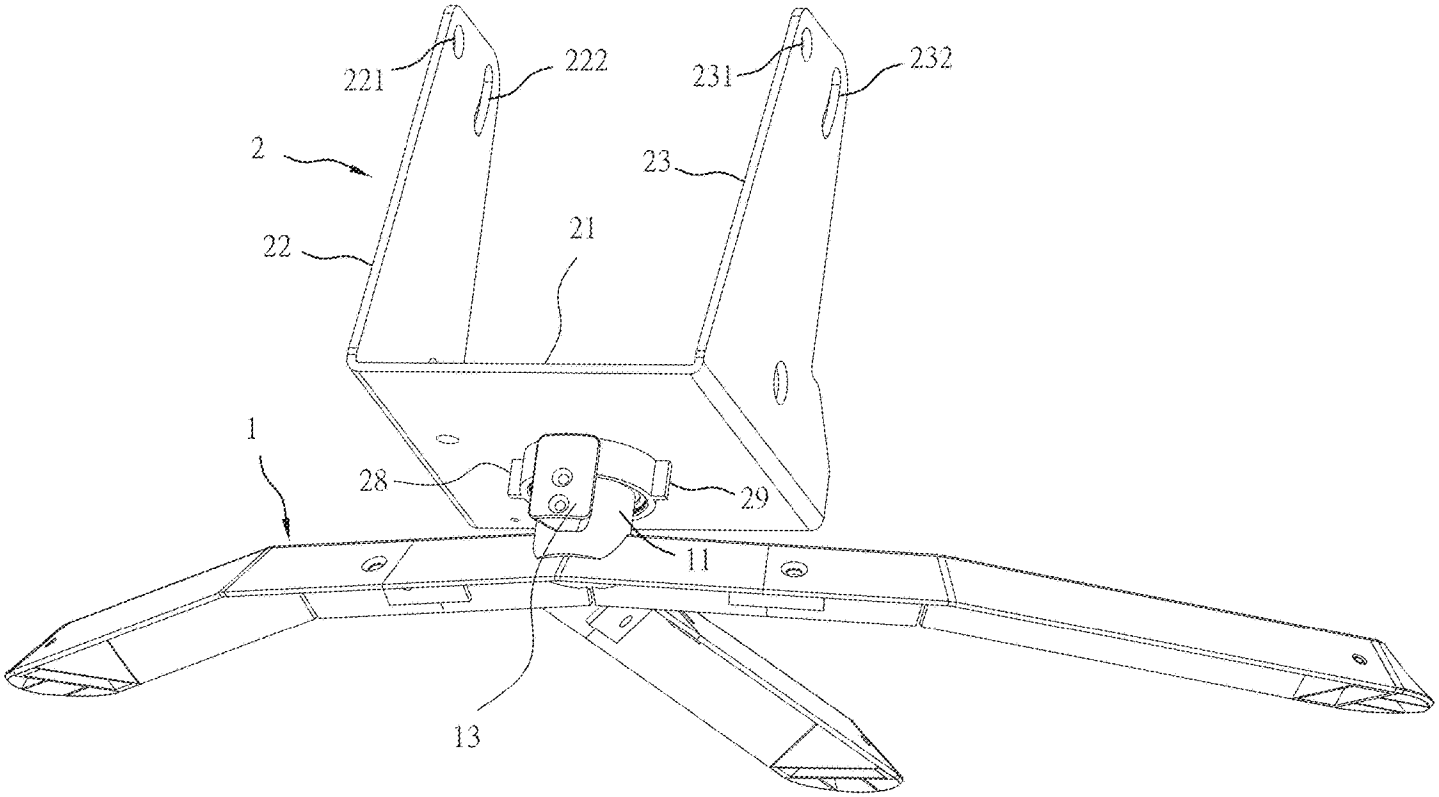
FIG. 3 is an oblique bottom elevation, in an enlarged scale, of the trap frame connector of the trap wobbler.
Figure 4:
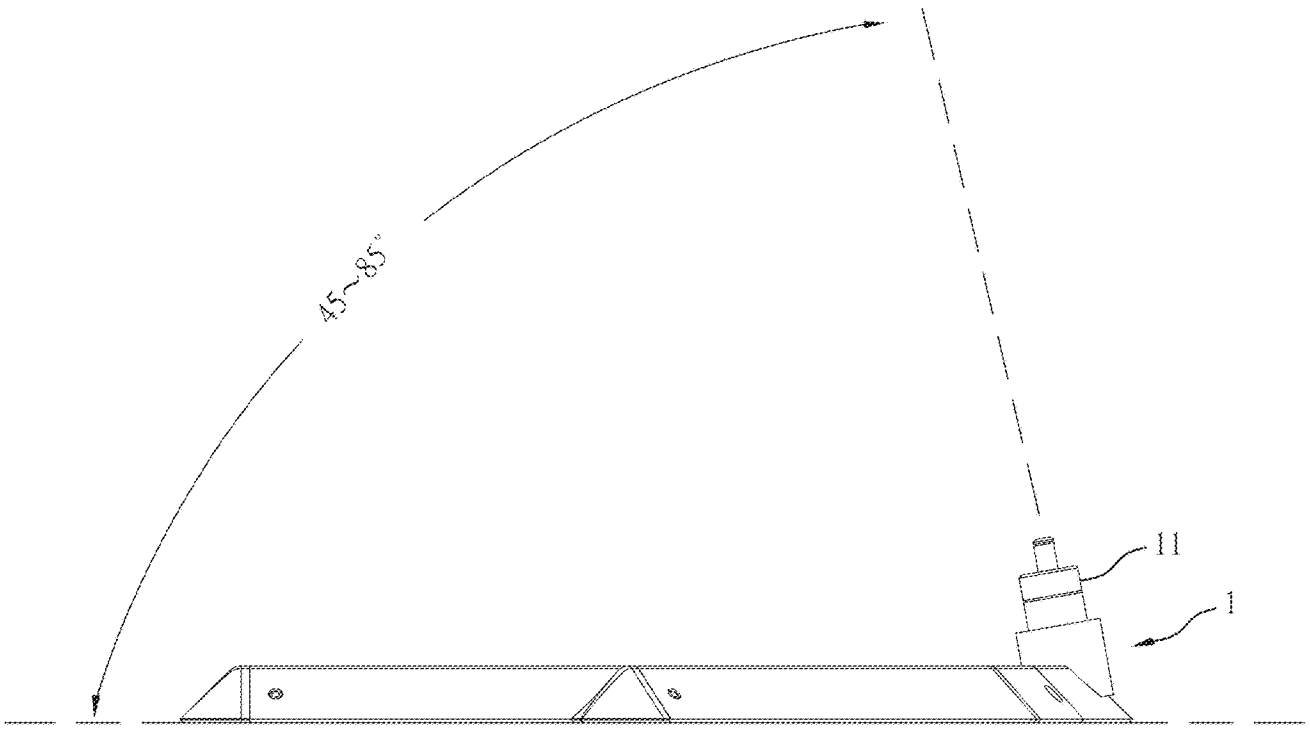
FIG. 4 is a side plain view, in an enlarged scale, of the base of the trap wobbler.

Referring to FIG. 3, the base 1 further comprises a stop block 13 located at the inclined bearing seat 11; the trap frame connector 2 further comprises a first stopper portion 28 and a second stopper portion 29 located at a bottom surface of the bottom wall 21 and alternatively stoppable by the stop block 13 to limit the pivoting angle of the trap frame connector 2 relative to the base 1, thereby limiting the throwing angle of the throwing arm 33 of the throwing trap 3 in throwing the clay 30.

In conclusion, the invention has the features and effects as follows:

1. When the throwing arm 33 of the throwing trap 3 is rotated to throw a clay 30 by a centrifugal force, the inertia force thus generated causes the throwing trap 3 and the connected trap frame connector 2 to swing left and right on the center of the inclined bearing seat 11 of the base 1. As long as the throwing arm 33 is continuously controlled to continue throwing a clay 30 before the swinging action of the throwing trap 3 is not yet stationary, the left and right swinging motions and amplitudes of the throwing trap 3 can be continuously increased, thereby causing an unpredictable swing angle. Thus, the aiming hit difficulty of the clay 30 thrown by the throwing arm 33 of the throwing trap 3 is relatively increased, thereby further enhancing the effect of the aiming practice of the throwing trap 3.

2. There is no need to separately assemble a motor and a transmission mechanism for swinging the throwing trap, which saves electricity, component cost and volume, thereby saving manpower and man-hours for assembling the aforementioned mechanism.

What is claimed is:

1. A trap wobbler, comprising:

a base comprising an inclined bearing seat and at least one bearing supported on said inclined bearing seat, the angle defined between the center of said inclined bearing seat and the horizontal plane being within the range of 45°~85°;

a trap frame connector comprising a bottom wall, opposing left wall and right wall respectively extended from opposing left and right sides of said bottom wall, a pivot slot located on said bottom wall and pivotally coupled to said at least one bearing at said inclined bearing seat of said base for enabling said trap frame connector to be biased relative to said base and a plurality of mounting holes respectively and symmetrically located on said left wall and said right wall; and a throwing trap comprising a plurality of connection holes respectively and symmetrically located on opposing left and right side of a bottom part thereof and respectively fastened to said mounting holes of said trap frame connector by respective fastening members and a throwing arm rotatable to throw a clay;

wherein:

when said throwing arm of said throwing trap is rotated to throw a clay by a centrifugal force, the inertia force thus generated causes said throwing trap and said trap frame connector to swing left and right on the center of said inclined bearing seat of said base; as long as said throwing arm is continuously controlled to continue throwing a clay before stopping of the swinging action of said throwing trap, the left and right swinging motions and amplitudes of said throwing trap is continuously increased, thereby causing an unpredictable swing angle.

2. The trap wobbler as claimed in claim 1, wherein said base further comprises a stop block located at said inclined bearing seat; said trap frame connector further comprises a first stopper portion and a second stopper portion located at a bottom surface of said bottom wall and alternatively stoppable by said stop block to limit the pivoting angle of said trap frame connector relative to said base.

* * * * *